US005590723A

United States Patent [19]

Walker et al.

[11] Patent Number: 5,590,723

[45] Date of Patent: Jan. 7, 1997

[54] PERFORATING CHARGE CARRIER ASSEMBLY

[75] Inventors: Jerry L. Walker; Victor M. Carrera, both of Fort Worth; Donald R. Carter, Burleson, all of Tex.

[73] Assignee: Halliburton Company, Houston, Tex.

[21] Appl. No.: 311,284

[22] Filed: Sep. 22, 1994

(Under 37 CFR 1.47)

[51] Int. Cl.[6] ..... E21B 43/116

[52] U.S. Cl. ..... 175/4.6; 102/312; 102/320; 102/321

[58] Field of Search ..... 175/4.51, 4.55, 175/4.6; 166/55.1, 55.2; 102/312, 320, 321

[56] References Cited

U.S. PATENT DOCUMENTS

| | | | |
|---|---|---|---|
| 2,927,534 | 3/1960 | Bus | 175/4.6 |
| 3,094,930 | 6/1963 | Blair | 175/4.6 |
| 3,100,443 | 8/1963 | Pohoriles | 175/4.6 |
| 4,326,462 | 4/1982 | Garcia et al. | 175/4.6 X |
| 4,393,946 | 7/1983 | Pottier et al. | 102/321 X |
| 4,681,037 | 7/1987 | Regalbuto | 175/4.6 X |
| 4,694,754 | 9/1987 | Dines et al. | 102/321 X |
| 4,951,744 | 8/1990 | Rytlewski | 102/321 X |
| 5,095,999 | 3/1992 | Markel | 175/4.6 |
| 5,107,929 | 4/1992 | Lopez de Cardenas | 175/4.6 X |
| 5,421,418 | 6/1995 | Nelson et al. | 175/4.6 X |

*Primary Examiner*—Frank Tsay

[57] ABSTRACT

The invention provides a new strip carrier assembly for carrying shaped charges, such as is particularly useful in perforating guns as are utilized to perforate oil and gas wells. The strip carrier includes a coupling member which couples adjacent strip carrier members together to form a contiguous assembly, and which further provides mounting system for a shaped charge so as to maintain uniform spacing even across the coupling junction. Additionally, the carrier assembly includes a novel tab assembly which cooperates with a charge carrier housing configuration to provide a single assemblage of parts which is capable of orienting shaped charges in any one of a plurality of desired orientations relative to the carrier strip.

7 Claims, 5 Drawing Sheets

PERFORATING CHARGE CARRIER ASSEMBLY

BACKGROUND OF THE INVENTION

The present invention relates generally to assemblies for supporting perforating charges, such as are used in oil and gas wells; and more specifically relates to a perforating charge carrier assembly for a type suitable for use in down hole perforating guns.

Conventional perforating guns include charge carriers to support a number of perforating charges, such as shaped charges, within a housing in a desired longitudinal spacing, and in some cases, a desired radial orientation. Many different types of charge carriers are known including carriers having a cross-section in the shape of a square or triangle. Additionally, charge carders are known which utilize a single longitudinal strip to support the charges.

A problem typically encountered with conventional strip charge carriers, however, is that where two strips are joined together (such as in a long longitudinal length of charges), conventional designs typically include a gap in possible charge placement where two charge carrier strips are coupled together. This gap in charge placement at the location of the coupling, therefore, breaks the typically desirable uniform spacing of the perforating charges. An additional problem typically encountered with conventional strip charge carriers is that the radial orientation of the charges is typically limited to either only one orientation or two diametrically opposed radial orientations of the charges. Thus, for example, conventional strip carriers do not readily facilitate the arranging of shot direction at all radial orientations which might be desired.

Accordingly, the present invention provides a new method and apparatus for joining strip-charge carriers without disrupting uniform spacing of the perforating charges; and which further facilitates the arranging of the perforating charges at any of a plurality of radial orientations through the use of an assembly of uniform components.

SUMMARY OF THE INVENTION

The present invention provides a new perforating assembly which solves problems experienced with conventional designs. In a first aspect of the present invention, the perforating assembly comprises an assembly of an elongated carrier strip assembly wherein a first elongated carrier strip and a second elongated carrier strip may be coupled with one another by a coupling plate without interrupting a uniform spacing of shaped charges throughout said assembly. In one preferred implementation, the coupling plate includes a central portion which will abut proximal adjacent ends of the first and second carrier strips. This central portion has coupled to it longitudinally opposed end pieces which are laterally offset to one side of the central portion, such that they will overlie the interior surfaces of the strip carriers. These end portions may be appropriately coupled, such as through bolts, to corresponding apertures in the first and second elongated carrier strips. The central portion of the coupling plate will preferably include one or more apertures, or other appropriate mechanisms, for securing a shaped charge to the remainder of the assembly. Accordingly, through use of end portions which do not interfere with adjacent spaced shape charges, the first and second elongated carrier strips may be coupled together, with a shaped charge in the coupling plate such that uniform spacing of shape charges is achieved throughout the assembly.

In another aspect of the invention, a novel configuration of mounting clip, and shaped charge may cooperate with an elongated carrier strip to facilitate an optimal distribution of perforating charge shot orientation with minimal componentry. In one particularly preferred embodiment, the assembly will include a mounting clip which defines a support face which will essentially lie perpendicular to the direction of charge of a shape charge, and which also defines a mounting plane which is defined by tabs or other members which will couple to an elongated carrier strip. If the plane of the support face and the plane of the mounting face are extended, they would preferably intersect one another and form an angle of from 22° to 67°. In a particularly preferred embodiment, the angle of intersection would be 45°.

Also in this particularly preferred embodiment, the clip is mountable in two orientations, wherein the support face extends to opposite sides of the plane symmetrical to said strip member. Further, the shape charges are insertable through said mounting clip in either of two orientations. This variance, therefore, provides four options in this preferred embodiment, for distinct orientations of the shot direction of each perforating charge, with each direction being offset from a next adjacent orientation by 90°.

DETAILED DESCRIPTION OF THE DRAWINGS

Figure 10:
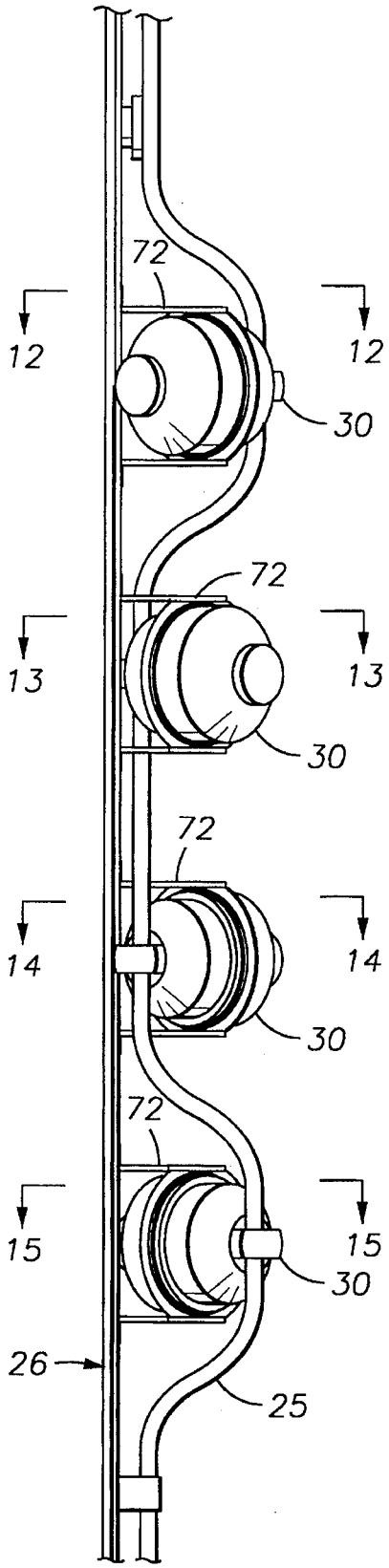
FIG. 10 depicts an exemplary strip carrier assembly including perforating charges demonstrating the capabilities achievable with the apparatus depicted in FIG. 6.
Figure 11:
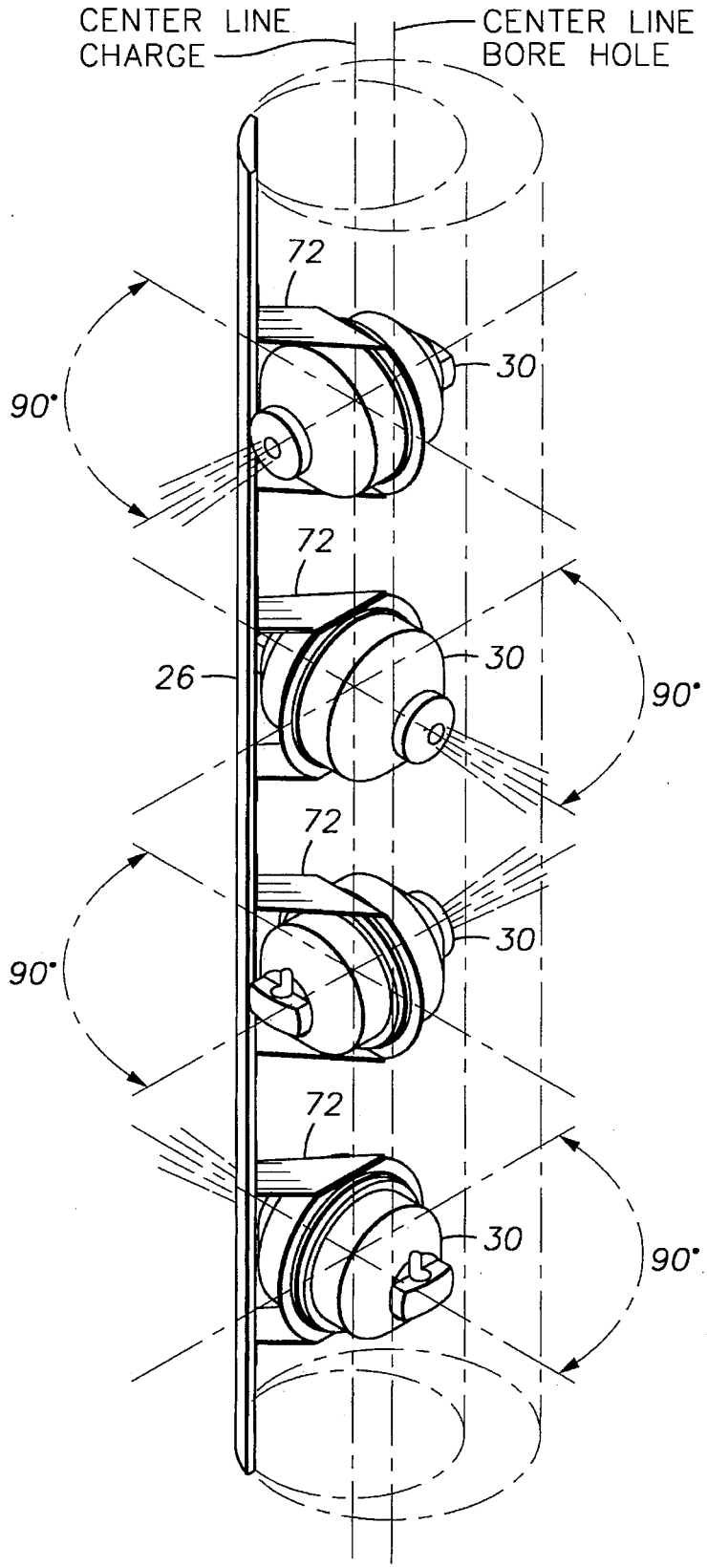

FIG. 11 more clearly depicts the offsets of direction achieved with the apparatus of FIG. 10.

Figure 12:
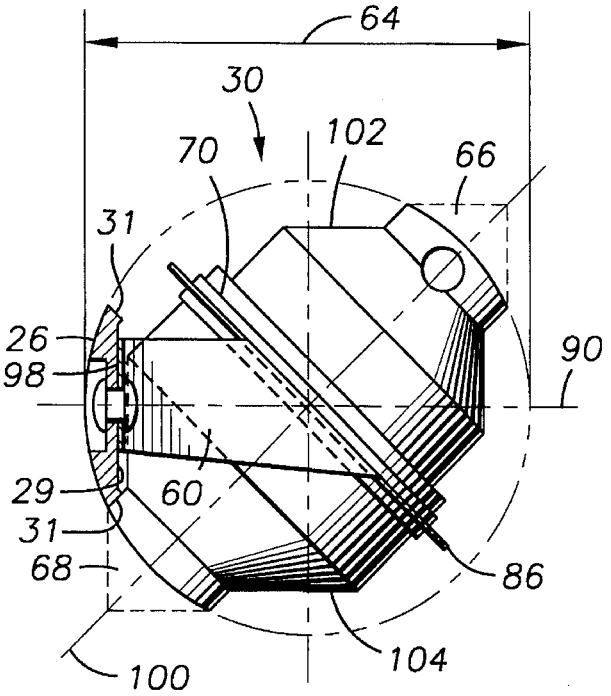

FIG. 12 depicts the apparatus of FIG. 10, through lines 12—12 therein.

Figure 13:
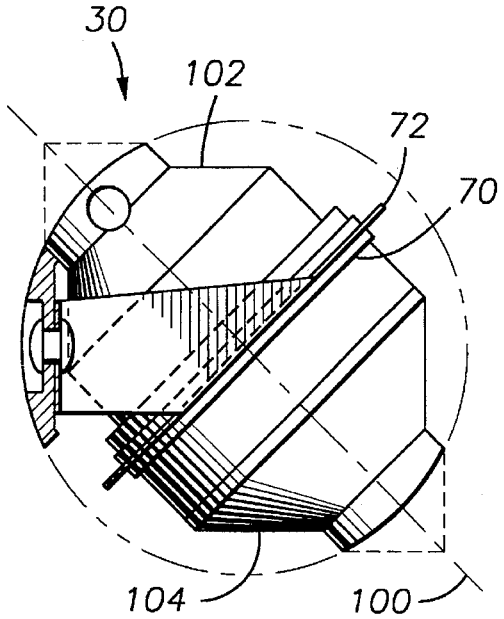

FIG. 13 depicts the apparatus of FIG. 10, through lines 13—13 therein.

Figure 14:
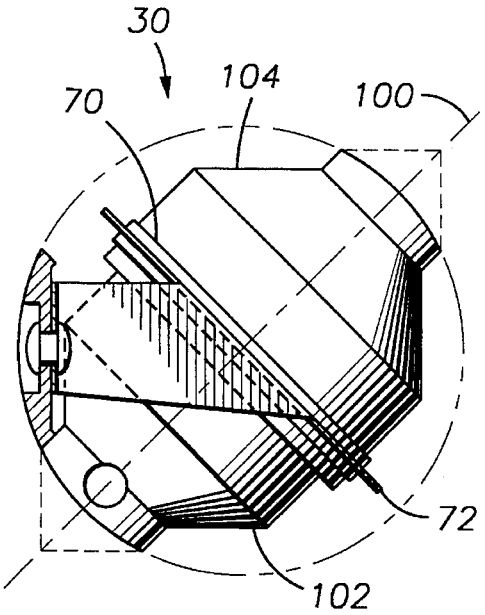

FIG. 14 depicts the apparatus of FIG. 10, through lines 14—14 therein.

Figure 15:
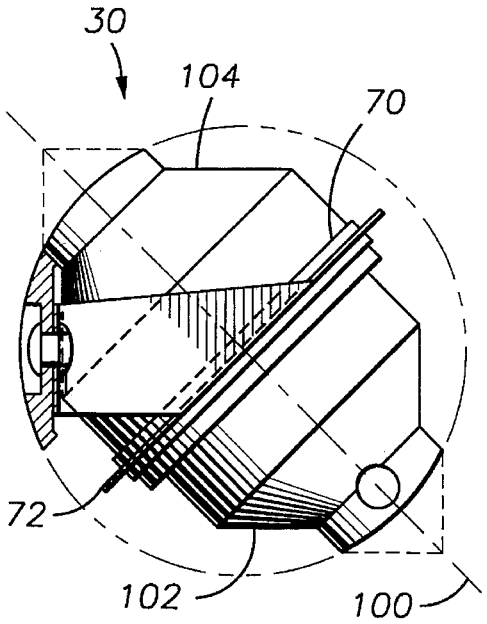

FIG. 15 depicts the apparatus of FIG. 10, through lines 15—15 therein.

DETAILED DESCRIPTION OF PREFERRED EMBODIMENTS

Figure 1:
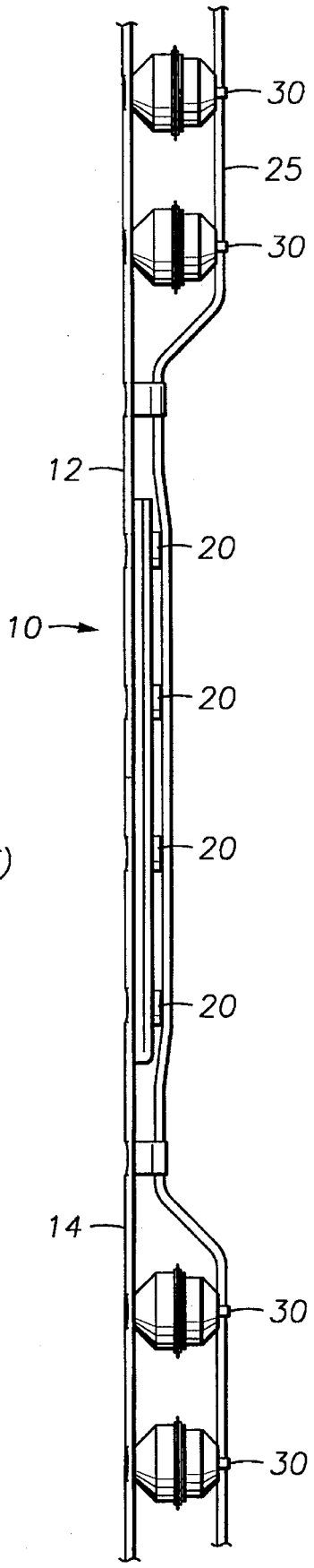
FIG. 1 (PRIOR ART)
FIG. 1 depicts an exemplary prior art strip carrier assembly.

Referring now to the drawings in more detail, and particularly to FIG. 1, therein is depicted an exemplary prior art configuration for a strip carrier assembly for supporting perforating charges, such as shaped charges, within a perforating gun. The shaped charge assembly 30 depicted is not believed to represent prior art to the current application. Carrier strip assembly 10 comprises a first elongated strip-carrier member 12 and a second elongated strip-carrier member 14, which are placed in longitudinally aligned, abutting, relationship at 16. The longitudinally extending tie plate 18 extends across the abutment and is coupled by a plurality of threaded fasteners ("bolts") 20 to first and second elongated strip carrier members 12 and 14. Tie plate 18, therefore, serves to anchor the two strip-carder members in longitudinally aligned position. A plurality of shaped charges 30 are coupled to the strip carrier assembly 10, and are interconnected with detonating cord 25 in a conventional manner. As is readily apparent from FIG. 1, however, this type of configuration takes up substantial room, and precludes the placement of perforating charges at uniform and uninterrupted spacings throughout the length of the entire strip-carrier assembly 10.

Referring now to FIGS. 2–5 in more detail, therein is depicted an exemplary strip carrier assembly 24, in accordance with the present invention. Strip carrier assembly 24 includes first and second strip members 26 and 28, respectively. Strip members 26 and 28 are each elongated members having provisions for the retaining of shaped charges 30, thereto. In this particularly preferred embodiment, each strip member 26, 28 includes a cross-section having a generally curvilinear exterior surface 27 and an opposing generally flat surface 29. For example, see strip member 26 as depicted in cross-section in FIG. 12. A pair of tabs preferably extend from the cross-section beyond flat surface 29. Such a configuration allows each strip member 26, 28 to rest securely against the interior bore of a perforating gun housing (depicted in phantom in FIG. 12). Such housings, as are well known in the art, represent merely cylindrical enclosures which protect the strip-carrier assembly inside from the conditions within a wellbore. In one particular preferred embodiment, each strip member will be a drawn member.

Figure 5:
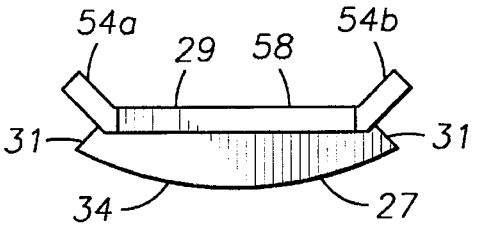
FIG. 5 depicts the tie plate of FIG. 4 from an end view.
Figure 3:
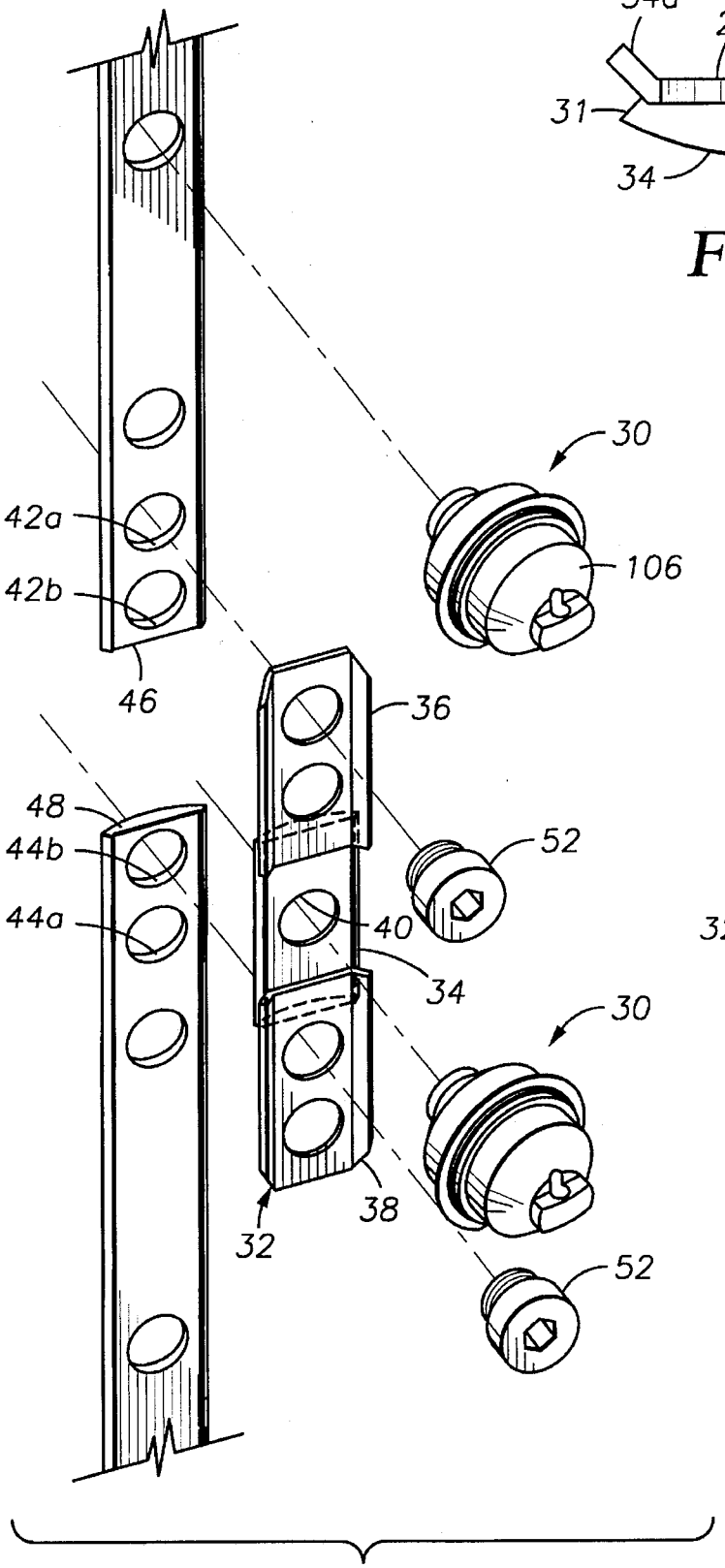
FIG. 3 depicts the strip carrier assembly of FIG. 2 in an exploded view.
Figure 4:
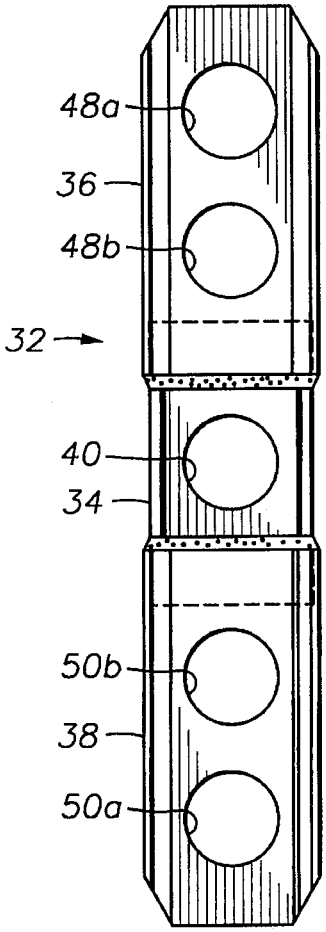
FIG. 4 depicts the tie place of FIG. 2 from a top view.
Figure 6:
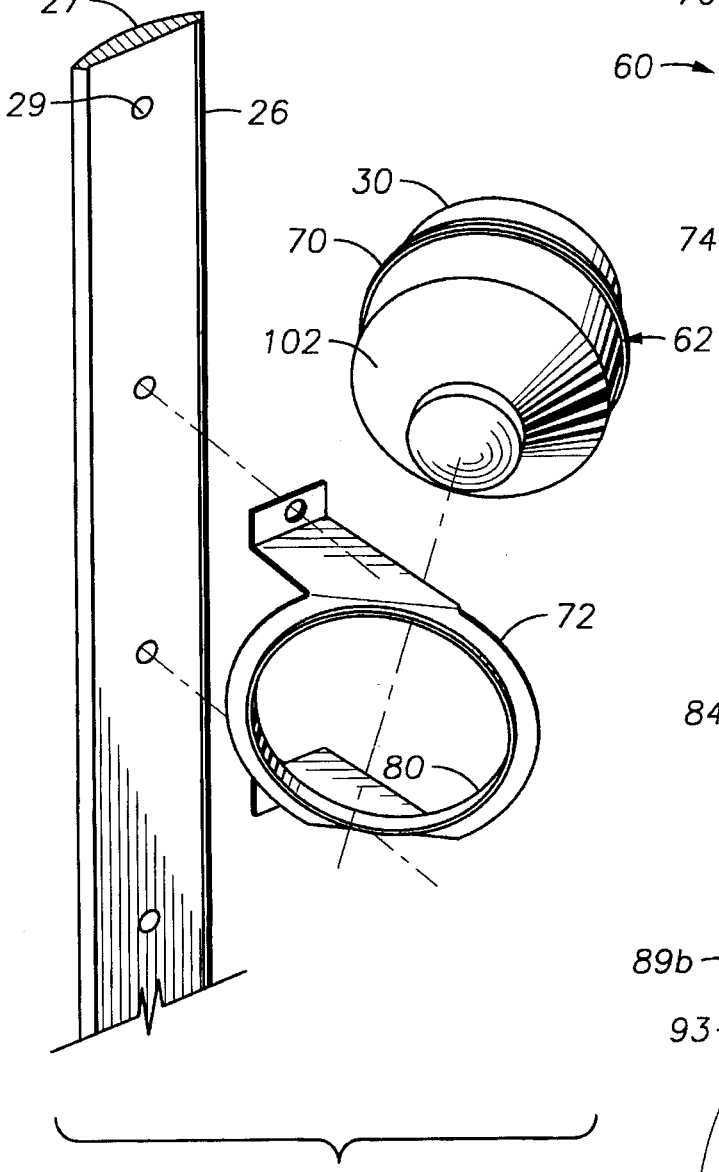
FIG. 6 depicts a clip assembly suitable for use with a strip carrier in accordance with the present invention.
Figure 8:
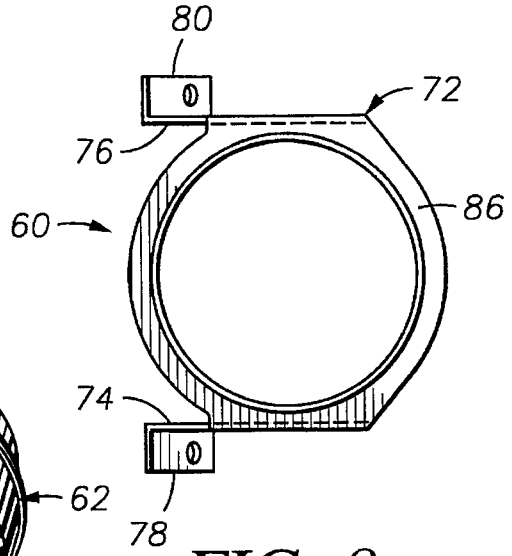
FIG. 8 depicts the clip of FIG. 6 from a frontal view.
Figure 9:
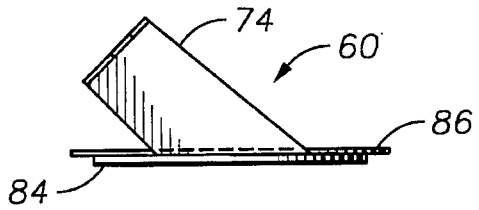
FIG. 9 depicts the clip of FIG. 6 and 8 from a side view.

Coupling strip members 26 and 28 together, is a coupling plate 32 in accordance with the present invention. As can best be seen in FIGS. 3 and 4, coupling plate 32 includes a central portion having a first, central, portion 34. Coupled proximate each end of central portion 34, and generally longitudinally aligned therewith, are first and second end portions 36 and 38, respectively. First and second end portions 36 and 38 are preferably of a comparable cross-section. This cross-section may be either the same as that of central portion 34, or may be different. Preferably, central portion 34 of coupling plate 30 will be a segment whose cross-section is selected to match that of the strip members to which it will abut. First and second end portions 36 and 38 of coupling plate 32 will preferably be constructed of a configuration as depicted, with flanges 54*a, b* extending toward one side of a generally flat central portion 58 so as to impart optimal rigidity to coupling plate 32 and to the assembly established through use thereof. In a particularly preferred embodiment as depicted herein, and as shown in FIG. 5, central portion 34 will have a cross-section which essentially matches the cross-section of strip members 26 and 28, while first and second end portions 36 and 38 will have a contrasting cross-section which is adapted to cooperatively engage the inner surface of strip members 26 and 28. First and second end portions 36 and 38 may be coupled to central portion 34 by any appropriate means, such as weldments.

In contrast to prior art designs, central portion 34 of coupling plate 32 will include an appropriate mechanism, such as threaded hole 40 (as depicted) for accepting and retaining a shaped charge 30. First and second strip members will each be provided with a pair of coupling apertures 42*a,b* and 44*a,b*, respectively, proximate their respective ends 46 and 48, respectively. Complimentary apertures 48*a,b* and 50*a,b* in first and second end-portions 36 and 38, respectively, of coupling plate 32 will align with the aforementioned apertures in strip members 26 and 28 when ends 46 and 48 of strip members 26 and 28 abut the upper and lower ends, respectively, of central portion 34 of coupling plate 32. A plurality of threaded connectors 52 will then threadably engage the corresponding apertures of 42*a*, 42*b*, 44*a*, 44*b* in strip members 26 and 28 to secure coupling plate 32 thereto, and to establish a single, longitudinal strip assembly.

Figure 2:
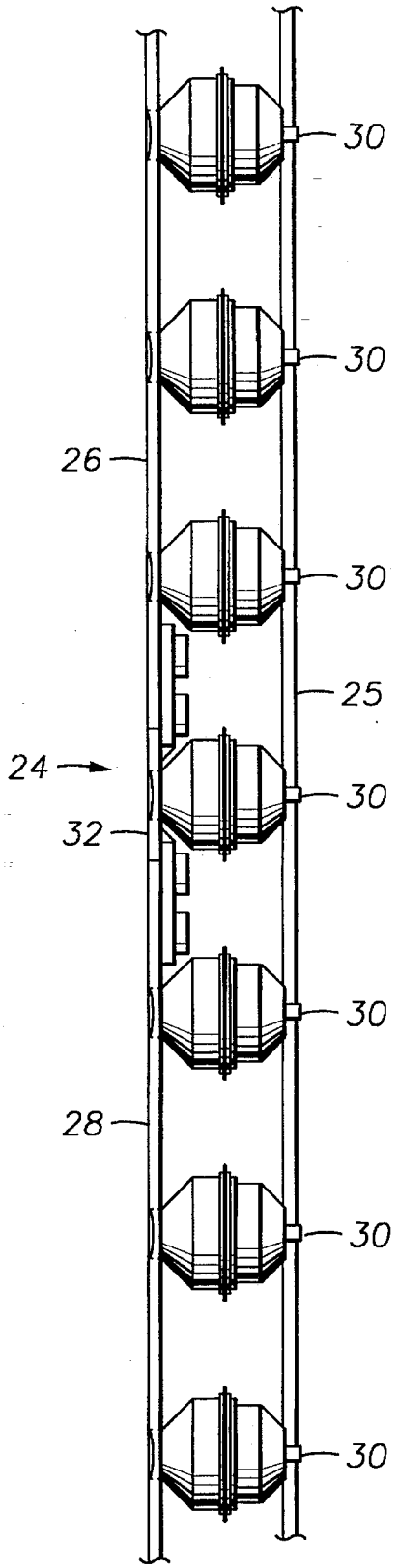
FIG. 2 depicts an exemplary carrier strip assembly including a coupling plate, in accordance with the present invention.

As is depicted in FIG. 2, a plurality of shaped charges 30 may be distributed along this assembly at equal and uniform spacing, thereby facilitating the assembling of a perforating gun which will uniformly perforate long distances, avoiding undesirable gaps in the perforating shot pattern.

Referring now to FIGS. 6–15, therein is depicted a novel charge mounting assembly 60 in according with another aspect of the present invention. The novel charge mounting assembly 60 may be utilized in accordance with a strip carrier assembly as depicted in FIGS. 1–5, or may be utilized with other types of strip carriers, as may be known to the art. Mounting assembly 60 is designed to function optimally with shaped charges 30 having a housing 62 of a particular configuration. As can best be seen in FIG. 12, shaped charge housing 62 is of a configuration which is adapted to fit within a predetermined diameter 64. Shaped charge housing 62 also includes housing ends which each include 90° included angles 66 and 68. Additionally, shaped charge housing 62 includes a central flange 70 which serves as an abutment for a mounting clip 72. The placement of central flange is determined in conjunction with the forming of mounting clip 72.

Figure 7:
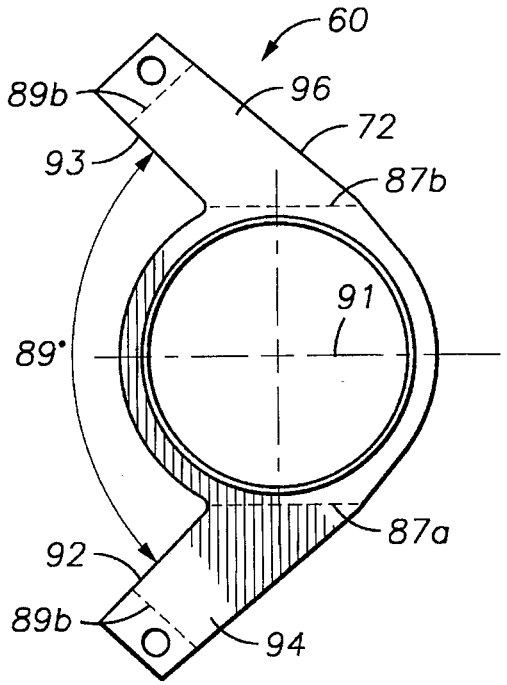
FIG. 7 depicts a stamping by which the clip member of FIG. 6 may be constructed.

Mounting clip 72 may be stamped or otherwise formed from a flat sheet of material, as depicted in FIG. 7. Such material may be, for example, 28 gauge steel. As will be apparent to those skilled-in-the-art, the precise dimensions of mounting clip 72 may be selected in response to the size restrictions imposed by the particular strip carrier, housing, and shaped charges utilized. As a flat member, the mounting clip form (FIG. 7) includes flanges 94, 96 extending from a central support face 86. Support face 86 includes a charge-receiving aperture 82. The included angle between said flanges 94, 96, along with the placement of bend lines 87*a, b* and 89*a, b* will establish an angular orientation of support face 86 relative to mounting tabs 78 and 80 when mounting clip 72 is formed. In one preferred embodiment a 90° included angle 89 will be formed between inner surfaces 92, 93 of mounting clip form (see FIG. 7). When bend lines 87*a, b* are oriented parallel to a line 91 bisecting this angle, and when flanges 94, 98 are bent at a 90° angle, support face will extend at an angle of 45° relative to a plane extending upwardly across the inner surfaces 92, 93 of flanges 94, 96 (forming legs 74, 76).

Once the extending flanges are bent twice at bend lines 87*a,b* and 89*a,b* to form downward extending legs 74 and 76 and mounting tabs 78 and 80, mounting clip 72 is formed. In a particularly preferred embodiment, central aperture 82 in mounting clip 72 is surrounded by a slight downwardly extending lip 84, extending from the otherwise relatively planer surface 86 of clip proximate central aperture 82. The placement of central flange 70 on charge housing 62 is determined such that shaped charge housing may be inserted from either direction, and will extend essentially symmetrically relative to mounting clip 72.

As can best be seen in reference to FIGS. 12–15, mounting clip 72 may be secured to strip member 26 with the mounting tabs 78 and 80 generally longitudinally arranged along strip member 26 but with the retaining face 86 extending toward opposite sides of a hypothetical plane 98 symmetrically placed relative to strip carrier 26. In this embodiment, mounting clip 72 will preferably be coupled to strip through insertable fasteners, such as rivets, engaging apertures 75 in strip 26. Recesses may be provided on the curvilinear surface 27 of strip 26 to accommodate the rivets. In one particularly preferred embodiment, support face 86 of mounting clip 72 will be disposed at an angle which is 45° offset from plane 90, resulting in the axis 100 through said mounting aperture 82 facing 45° offset from plane 90. As is readily apparent to those skilled in the art, however, additional geometrical configurations may also be selected.

As is best depicted in FIG. 12, either front mounting surface 102 or rear mounting surface 104 of shaped charge 30 may lie proximate top surface 29 of strip member 26. Further, inwardly extending tabs 31 will engage either surface 102 or 104 of shaped charge 30 depending on the orientation in which shaped charge 30 is disposed through aperture 82 in mounting clip 72. Thus, as can be seen from a comparison of FIGS. 12 and 14, the depicted assemblies are essentially identical with the exception of the alternate orientation of shaped charge 30 through aperture 82 in mounting clip 72.

In an analogous manner, in FIGS. 13 and 15, mounting clip 72 has been attached to strip member 26 prime in the reversed orientation (relative to that of FIGS. 12 and 14), and shaped charge 30 is again oriented in alternating directions (between FIGS. 13 and 15). This capability allows one configuration of shaped charge mounting assembly to be assembled in the four configurations depicted in FIGS. 10 and 11, and provide a so-called "spiral," with the four longitudinally disposed charges arranged facing in four directions, each offset from the adjacent shots by 90°.

As will be apparent to those skilled in the art, other geometries may be utilized with the mounting clip, to achieve alternative distributions.

Many modifications and variations may be made in the technique and structures described and illustrated herein without departing from the spirit and scope of the present invention. Accordingly, it should be readily understood that the techniques and structures described and illustrated herein are illustrative only, and are not to be considered as limitations upon the scope of the present invention.

What is claimed is:

1. A perforating assembly for use in a perforating gun, comprising:

a first elongated carrier configured to support a plurality of shaped charges spaced uniformly along the length of said first elongated carrier, said elongated carrier having a predetermined cross-section;

a second elongated carrier configured to support a plurality of shape charges spaced uniformly along the length of said second elongated carrier, the spacing between shape charges on said first carrier being generally the same as the spacing of shape charges on said second carrier, said second elongated carrier also having a predetermined cross-section;

a coupling plate coupled between said first and second elongated carriers to form an elongated strip assembly, said coupling plate having a first portion extending between first and second elongated carriers, and having second and third portions being laterally offset to one side of said first portion and longitudinally disposed on either end of said first portion, said coupling plate being able to hold at least one shape charge, such that said shape charges on said first carrier, said shape charges on said second carrier, and said at least one shape charge on said coupling plate together form a series of shape charges that are all uniformly spaced apart.

2. The perforating assemblies of claim 1, wherein said first and second elongated carriers have a common predetermined cross-section, and wherein said first portion of said coupling plate has a cross-section which is approximately that of said cross-section of said first and second elongated carriers.

3. The perforating assembly of claim 1, wherein said second and third portions are coupled to said first portion by a weldment.

4. A perforating assembly for use in a perforating gun, comprising:

a strip member;

a mounting clip comprising a support face, said mounting clip configured to be mountable to said strip member in a plurality of orientations, said support face extending to one side of said strip member when said mounting clip is secured thereto, said mounting clip having a central aperture for receiving a perforating charge; and a perforating charge insertable through said central aperture of said mounting clip, and cooperatively configured with said mounting clip and said strip member to be retained between said mounting clip and said strip member when inserted in through said central aperture in said mounting clip from either of two directions when said mounting clip is secured to said strip member thereby allowing said perforating charge to be mountable in at least four different alignments.

5. The perforating assembly of claim 4, wherein said strip member comprises a generally planar inner surface, and wherein said support face extends away from said planar surface at an angle of approximately 45°.

6. The perforating assembly of claim 4, wherein said assembly comprises a plurality of mounting clips, and wherein said mounting clips are coupleable to said strip member in either of two orientations, with said support face extending to opposite sides of said strip member when coupled in either of said two orientations.

7. The perforating assembly of claim 4, wherein said perforating charge comprises a housing, and wherein said charge housing and said strip member are cooperatively configured to engage one another when said perforating charge is engaged between said mounting clip and said member and when said mounting clip is secured to said strip member.

* * * * *